US009402442B2

(12) United States Patent
Rapf et al.

(10) Patent No.: US 9,402,442 B2
(45) Date of Patent: Aug. 2, 2016

(54) SOLE STRUCTURE AND ARTICLE OF FOOTWEAR INCLUDING SAME

(75) Inventors: Brooke P. Rapf, Lake Oswego, OR (US); Thomas J. Rushbrook, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 431 days.

(21) Appl. No.: 13/458,229

(22) Filed: Apr. 27, 2012

(65) Prior Publication Data

US 2013/0283641 A1 Oct. 31, 2013

(51) Int. Cl.

*A43C 15/00* (2006.01)
*A43B 13/26* (2006.01)
*A43B 13/14* (2006.01)

(52) U.S. Cl.

CPC ..... *A43B 13/26* (2013.01); *A43B 13/141* (2013.01)

(58) Field of Classification Search

CPC ..... A43B 13/12; A43B 13/141; A43B 13/26; A43B 13/00; A43B 13/145; A43B 13/026; A43B 13/223; A43B 5/00; A43B 21/06; A43C 15/161; A43C 15/162; A43C 15/165; A43C 15/167; A43C 13/04

See application file for complete search history.

(56) References Cited

U.S. PATENT DOCUMENTS

| | | | | |
|---|---|---|---|---|
| 830,324 | A | 9/1906 | Hunt | |
| 1,361,078 | A | 12/1920 | Lynn | |
| 1,458,201 | A | 6/1923 | Stedman | |
| 1,559,450 | A | 10/1925 | Oakley | |
| 2,087,945 | A | 7/1937 | Butler | |
| 2,090,881 | A | 8/1937 | Wilson | |
| 2,095,095 | A | 10/1937 | Howard | |
| 2,853,809 | A | 9/1958 | Bianchi | |
| 3,043,026 | A | 7/1962 | Semon | |
| 3,619,916 | A | 11/1971 | Neri | |
| 3,631,614 | A | 1/1972 | Rice | |
| 3,775,874 | A | 12/1973 | Bonneville | |
| 3,951,407 | A | 4/1976 | Calacurcio | |
| 4,085,527 | A | 4/1978 | Riggs | |
| 4,146,979 | A | 4/1979 | Fabbrie | |
| 4,223,459 | A | 9/1980 | Riggs | |
| 4,375,728 | A | 3/1983 | Dassler | |
| 4,375,729 | A | 3/1983 | Buchanen, III | |
| 4,378,643 | A * | 4/1983 | Johnson | 36/129 |

(Continued)

FOREIGN PATENT DOCUMENTS

| | | |
|---|---|---|
| CA | 2526727 | 5/2007 |
| DE | 930798 | 7/1955 |

(Continued)

OTHER PUBLICATIONS

Partial Search Report for PCT/US2009/058522 dated Mar. 4, 2010.

(Continued)

*Primary Examiner* — Khoa Huynh
*Assistant Examiner* — Megan Brandon
(74) *Attorney, Agent, or Firm* — Banner & Witcoff, Ltd.

(57) ABSTRACT

An article of footwear sole structure includes a flexible web. The flexible web is surrounded by a ridge extending downward from a bottom side of the web. Traction elements also extend downward from the web bottom side. When standing or casually walking, a substantial portion of the wearer's weight is transferred to the ground by the ridge. During golf play, increased downward force of the wearer on the web deforms the web and transfers more of the wearer weight onto various portions of the traction elements.

25 Claims, 8 Drawing Sheets

(56) References Cited

U.S. PATENT DOCUMENTS

| | | | | |
|---|---|---|---|---|
| 4,402,145 | A * | 9/1983 | Dassler | 36/32 R |
| 4,439,936 | A | 4/1984 | Clarke et al. | |
| 4,633,600 | A | 1/1987 | Dassler et al. | |
| 4,667,425 | A | 5/1987 | Effler et al. | |
| 4,674,200 | A | 6/1987 | Sing | |
| 4,715,133 | A | 12/1987 | Hartjes et al. | |
| 4,833,796 | A | 5/1989 | Flemming | |
| 4,873,774 | A | 10/1989 | Lafever | |
| 5,221,379 | A | 6/1993 | Nicholas | |
| 5,289,647 | A | 3/1994 | Mercer | |
| 5,299,369 | A | 4/1994 | Goldman | |
| 5,351,422 | A | 10/1994 | Fitzgerald | |
| 5,367,791 | A * | 11/1994 | Gross et al. | 36/31 |
| 5,410,823 | A | 5/1995 | Iyoob | |
| 5,513,451 | A | 5/1996 | Kataoka et al. | |
| 5,526,589 | A | 6/1996 | Jordan | |
| 5,619,809 | A * | 4/1997 | Sessa | 36/3 R |
| 5,634,283 | A | 6/1997 | Kastner | |
| 5,775,010 | A | 7/1998 | Kaneko | |
| 5,815,951 | A | 10/1998 | Jordan | |
| 5,943,794 | A | 8/1999 | Gelsomini | |
| 5,946,828 | A | 9/1999 | Jordan et al. | |
| 5,956,871 | A | 9/1999 | Korsen | |
| 5,979,083 | A | 11/1999 | Robinson et al. | |
| 6,076,283 | A * | 6/2000 | Boie | 36/59 C |
| 6,079,127 | A | 6/2000 | Nishimura et al. | |
| 6,112,433 | A | 9/2000 | Greiner | |
| 6,125,556 | A | 10/2000 | Peckler et al. | |
| 6,161,315 | A | 12/2000 | Dalton | |
| 6,256,907 | B1 | 7/2001 | Jordan et al. | |
| 6,354,022 | B2 | 3/2002 | Gelsomini | |
| 6,389,714 | B1 | 5/2002 | Mack | |
| 6,474,005 | B2 | 11/2002 | Kobayashi | |
| 6,481,122 | B2 | 11/2002 | Brahler | |
| 6,550,160 | B2 | 4/2003 | Miller, II | |
| D479,643 | S * | 9/2003 | O'Shea et al. | D2/951 |
| 6,615,512 | B2 | 9/2003 | Sink | |
| 6,647,647 | B2 | 11/2003 | Auger et al. | |
| 6,665,961 | B2 | 12/2003 | Kobayashi et al. | |
| 6,675,505 | B2 | 1/2004 | Terashima | |
| 6,698,110 | B1 | 3/2004 | Robbins | |
| 6,739,075 | B2 | 5/2004 | Sizemore | |
| D495,122 | S | 8/2004 | McMullin | |
| 6,904,707 | B2 | 6/2005 | McMullin | |
| 6,915,595 | B2 | 7/2005 | Kastner | |
| 6,915,596 | B2 | 7/2005 | Grove et al. | |
| 6,941,684 | B2 | 9/2005 | Auger et al. | |
| 7,007,410 | B2 | 3/2006 | Auger et al. | |
| 7,143,530 | B2 | 12/2006 | Hudson et al. | |
| 7,194,826 | B2 | 3/2007 | Ungari | |
| 7,234,250 | B2 | 6/2007 | Fogarty et al. | |
| 7,246,454 | B2 * | 7/2007 | Kramer | 36/44 |
| 7,254,909 | B2 | 8/2007 | Ungari | |
| 7,269,916 | B2 | 9/2007 | Biancucci et al. | |
| 7,287,343 | B2 | 10/2007 | Healy | |
| 7,370,439 | B1 * | 5/2008 | Myers | 36/31 |
| 7,386,948 | B2 | 6/2008 | Sink | |
| 7,406,781 | B2 | 8/2008 | Scholz | |
| 7,409,783 | B2 | 8/2008 | Spike | |
| 7,430,819 | B2 | 10/2008 | Auger et al. | |
| 7,490,418 | B2 | 2/2009 | Obeydani | |
| 7,565,754 | B1 * | 7/2009 | Acheson et al. | 36/28 |
| 7,584,554 | B2 | 9/2009 | Fogarty et al. | |
| 7,784,196 | B1 | 8/2010 | Christensen et al. | |
| 7,814,686 | B2 * | 10/2010 | Becker et al. | 36/102 |
| 8,079,160 | B2 * | 12/2011 | Baucom et al. | 36/61 |
| 8,122,617 | B1 | 2/2012 | Dixon et al. | |
| 2001/0016993 | A1 * | 8/2001 | Cagner | 36/102 |
| 2002/0017036 | A1 | 2/2002 | Berger et al. | |
| 2002/0040539 | A1 * | 4/2002 | Kobayashi et al. | 36/127 |
| 2002/0178620 | A1 * | 12/2002 | Asciolla | 36/132 |
| 2003/0033731 | A1 | 2/2003 | Sizemore | |
| 2004/0035024 | A1 | 2/2004 | Kao | |
| 2004/0187356 | A1 | 9/2004 | Patton | |
| 2004/0250451 | A1 | 12/2004 | McMullin | |
| 2005/0072026 | A1 | 4/2005 | Sink | |
| 2005/0210705 | A1 * | 9/2005 | Grove et al. | 36/25 R |
| 2005/0217149 | A1 | 10/2005 | Ho | |
| 2005/0257405 | A1 | 11/2005 | Kilgore | |
| 2005/0268490 | A1 | 12/2005 | Foxen | |
| 2006/0016101 | A1 | 1/2006 | Ungari | |
| 2006/0021254 | A1 | 2/2006 | Jones | |
| 2006/0107551 | A1 | 5/2006 | Teng | |
| 2006/0130372 | A1 | 6/2006 | Auger et al. | |
| 2007/0240331 | A1 * | 10/2007 | Borel | 36/28 |
| 2007/0261271 | A1 | 11/2007 | Krouse | |
| 2007/0271815 | A1 * | 11/2007 | Moretti et al. | 36/3 B |
| 2007/0277401 | A1 * | 12/2007 | Young-Chul | A43B 13/12 36/30 R |
| 2007/0283595 | A1 * | 12/2007 | Bright | 36/25 R |
| 2008/0066348 | A1 | 3/2008 | O'Brien et al. | |
| 2008/0196276 | A1 | 8/2008 | McMullin | |
| 2008/0201992 | A1 * | 8/2008 | Avar et al. | 36/25 R |
| 2008/0209769 | A1 * | 9/2008 | Polegato Moretti | 36/3 B |
| 2008/0216352 | A1 | 9/2008 | Baucom et al. | |
| 2008/0222921 | A1 * | 9/2008 | Gerber | 36/103 |
| 2008/0282579 | A1 * | 11/2008 | Bobbett et al. | 36/127 |
| 2009/0044428 | A1 * | 2/2009 | Bernardeschi | 36/103 |
| 2009/0056172 | A1 * | 3/2009 | Cho | 36/3 B |
| 2009/0090031 | A1 | 4/2009 | Jung | |
| 2009/0100716 | A1 | 4/2009 | Gerber | |
| 2009/0100718 | A1 | 4/2009 | Gerber | |
| 2009/0126230 | A1 * | 5/2009 | McDonald et al. | 36/88 |
| 2009/0193690 | A1 * | 8/2009 | Moretti | 36/3 B |
| 2009/0223088 | A1 | 9/2009 | Krikorian et al. | |
| 2009/0241370 | A1 | 10/2009 | Kimura | |
| 2009/0277047 | A1 * | 11/2009 | Polegato Moretti | 36/3 B |
| 2009/0307933 | A1 | 12/2009 | Leach | |
| 2009/0320330 | A1 * | 12/2009 | Borel et al. | 36/30 R |
| 2010/0077635 | A1 | 4/2010 | Baucom et al. | |
| 2010/0083541 | A1 | 4/2010 | Baucom et al. | |
| 2010/0251578 | A1 | 10/2010 | Auger et al. | |
| 2010/0281630 | A1 * | 11/2010 | Fogg et al. | 12/146 B |
| 2010/0299965 | A1 * | 12/2010 | Avar et al. | 36/102 |
| 2011/0047830 | A1 | 3/2011 | Francello et al. | |
| 2011/0047834 | A1 * | 3/2011 | Baker et al. | 36/67 A |
| 2011/0078927 | A1 | 4/2011 | Baker | |
| 2011/0126426 | A1 | 6/2011 | Amark | |
| 2011/0197478 | A1 | 8/2011 | Baker | |
| 2011/0203136 | A1 | 8/2011 | Auger | |
| 2011/0214313 | A1 * | 9/2011 | James et al. | 36/103 |
| 2011/0247243 | A1 * | 10/2011 | Eder et al. | 36/67 A |

FOREIGN PATENT DOCUMENTS

| | | |
|---|---|---|
| DE | 3046811 | 7/1982 |
| DE | 3245182 | 5/1983 |
| DE | 3600525 | 10/1987 |
| EP | 0223700 | 5/1987 |
| EP | 1714571 | 10/2006 |
| EP | 1839511 | 10/2007 |
| EP | 2057913 | 5/2009 |
| FR | 2567004 | 1/1986 |
| FR | 2818876 | 7/2002 |
| JP | 10000105 | 6/1998 |
| TW | 540323 U | 7/2003 |
| TW | M267886 U | 6/2005 |
| WO | 0053047 | 9/2000 |
| WO | 03071893 | 9/2003 |
| WO | 2006103619 | 10/2006 |
| WO | 2008069751 | 6/2008 |
| WO | 2008128712 | 10/2008 |
| WO | 2009110822 | 9/2009 |
| WO | 2010036988 | 4/2010 |
| WO | 2010057207 | 5/2010 |

OTHER PUBLICATIONS

International Search Report and Written Opinion of PCT/US2010/029640 dated May 17, 2010.

International Search Report and Written Opinion of PCT/US2009/058522 dated Feb. 17, 2010.

International Search Report and Written Opinion for PCT/US2010/050637 dated Jan. 14, 2011.

(56) References Cited

OTHER PUBLICATIONS

International Search Report and Written Opinion for PCT/US2011/022841 dated Apr. 15, 2011.
International Search Report and Written Opinion for PCT/US2011/022848 dated Jun. 20, 2011.
Aug. 12, 2010, Icebug web page (date based on information from Internet Archive).
Dec. 23, 2008, Icebug web page (date based on information from Internet Archive).
International Search Report and Written Opinion for PCT/US2011/045356 dated Dec. 16, 2011.

* cited by examiner

SOLE STRUCTURE AND ARTICLE OF FOOTWEAR INCLUDING SAME

BACKGROUND

"Outsole" is a term often used to describe bottom portions of a shoe sole structure. An outsole, or various parts of the outsole, will typically contact the ground when a shoe wearer stands or when the wearer walks or otherwise moves relative to the ground. In sports and other activities, a person's feet may experience a wide range of motion and/or support that person's weight during a range of different body motions. A sole structure designed to provide support or otherwise enhance performance during one type of motion may not be ideal for a different type of motion that a shoe wearer might also perform. For instance, some types of outsole elements may help increase traction when a shoe wearer walks or otherwise traverses various types of surfaces. However, that same shoe may also be worn when performing other activities that do not require that same type of propulsive effort. During those other activities it may be more desirable to stabilize the wearer foot during body motions that differ from motions experienced while walking.

Golf is one example of an activity in which a person's feet repeatedly experience different types of motions and body positions. A golfer may spend large amounts of time walking. Much of that walking may be over uneven surfaces and/or surfaces that might be slippery. It may thus be desirable to include outsole elements to increase traction when moving across such surfaces. However, the manner in which a golfer swings a club is an important aspect of golf. Proper foot placement and support are important during a golf swing. Because of differences between walking motions and swing motions, sole structures that increase traction while walking across a golf course may not be the best structures to stabilize a wearer's feet while swinging a golf club. Thus, there remains a need for structures that can adapt to the changing forces imposed on footwear as a golfer walks, swings a club, etc.

Moreover, a golfer may wish to wear the same shoes on and off the golf course. With conventional golf shoe designs, however, this may often not be practical. In many off-course environments (e.g., indoors, on the street, etc.), the wearer may have no need for special outsole structures that increase stability and/or traction while playing golf or while walking on a golf course. Such structures might be disadvantageous in many such off-course environments. When walking on a hard surface, for example, many types of fraction structures found on conventional golf shoes can impose uncomfortable localized pressures on the bottom of the shoe wearer's foot. Walking significant distances over hard surfaces in shoes having such traction structures is often not practical. As another example, many conventional golf shoe traction structures may snag carpeting or scratch various types of indoor flooring material. Indeed, golf shoes may not be permitted in some locations for this reason.

Many golf shoes are thus not suitable for wear in off-course settings. This can be a source of annoyance to golfers who find it inconvenient to change footwear when arriving at or leaving a golf course. Many such persons would find it advantageous to have a single pair of shoes that could provide support and traction while playing golf, but which could also be worn in off-course settings.

SUMMARY

This Summary is provided to introduce a selection of concepts in a simplified form that are further described below in the Detailed Description. This Summary is not intended to identify key or essential features of the invention.

In at least some embodiments, an article of footwear includes a sole structure having a flexible web. That flexible web is surrounded by a ridge extending downward from a bottom side of the web. Traction elements also extend downward from the web bottom side. When standing or casually walking, a substantial portion of the wearer's weight is transferred to the ground by the ridge. During golf play, increased downward force of the wearer on the web deforms the web and transfers more of the wearer weight onto various portions of the traction elements, thereby providing increased localized traction in regions of the wearer foot corresponding to the increased downward force.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

Figure 1A:
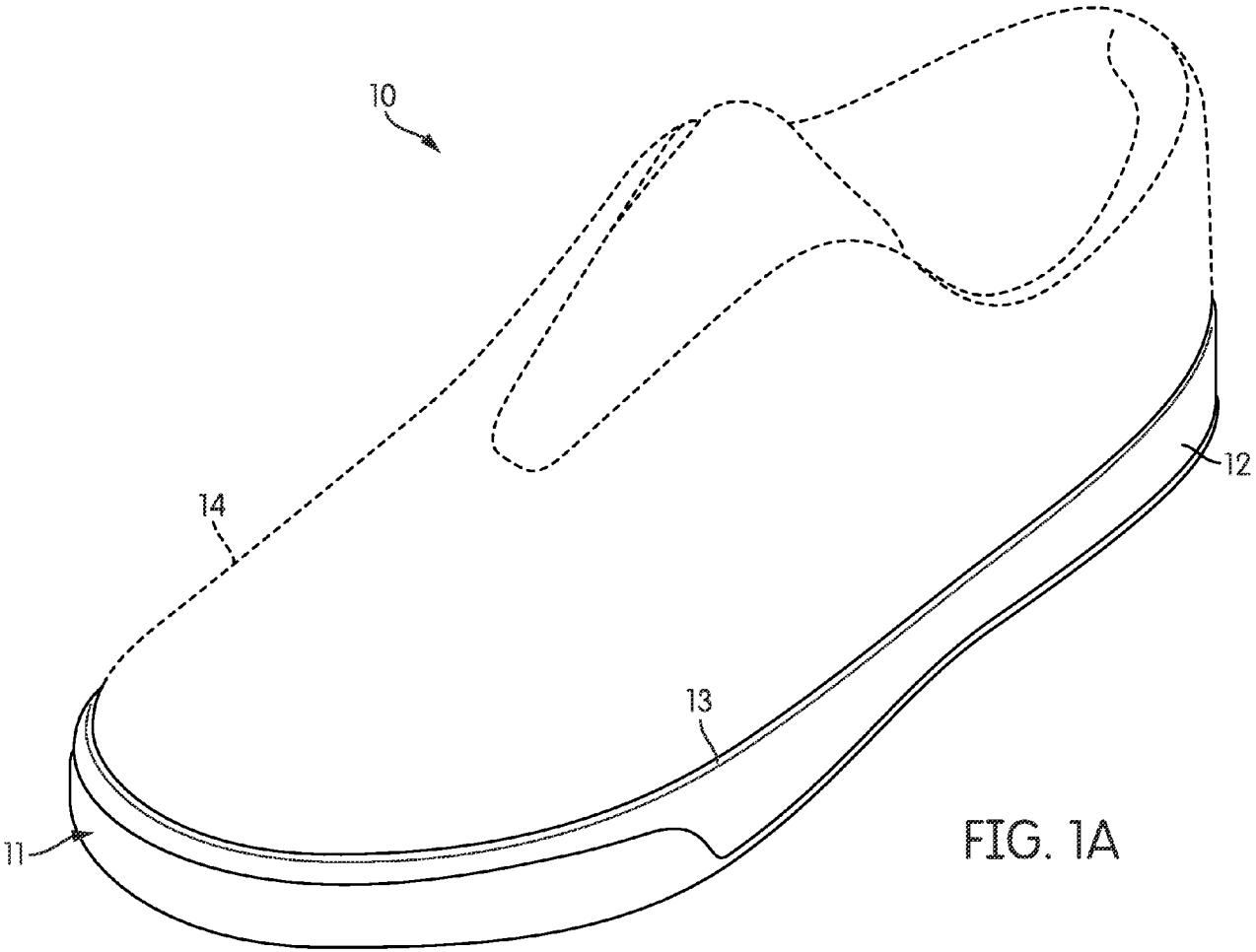
FIG. 1A is a lateral front perspective view of a shoe according to some embodiments.
Figure 1B:
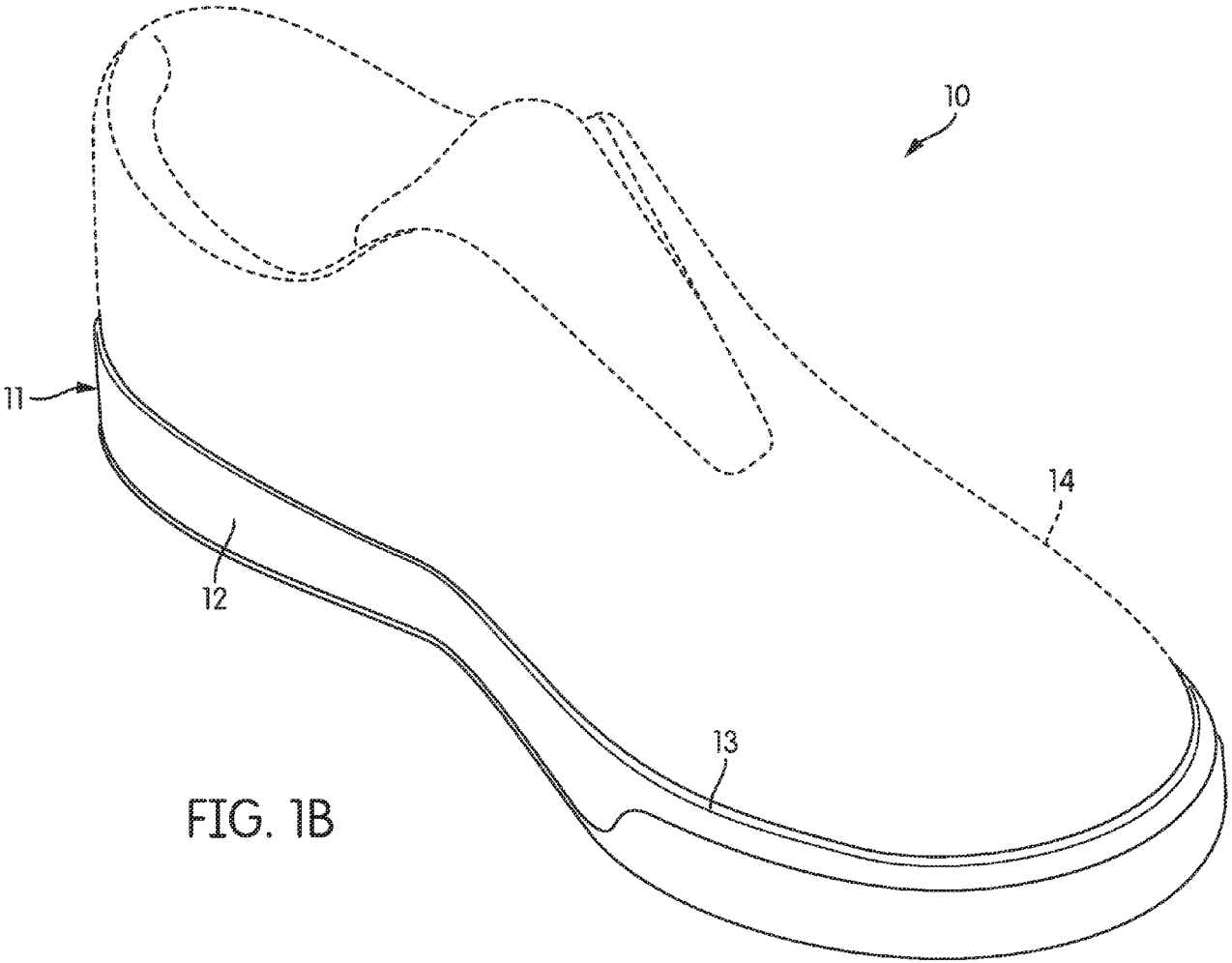
FIG. 1B is a medial front perspective view of the shoe of FIG. 1A.
Figure 1C:
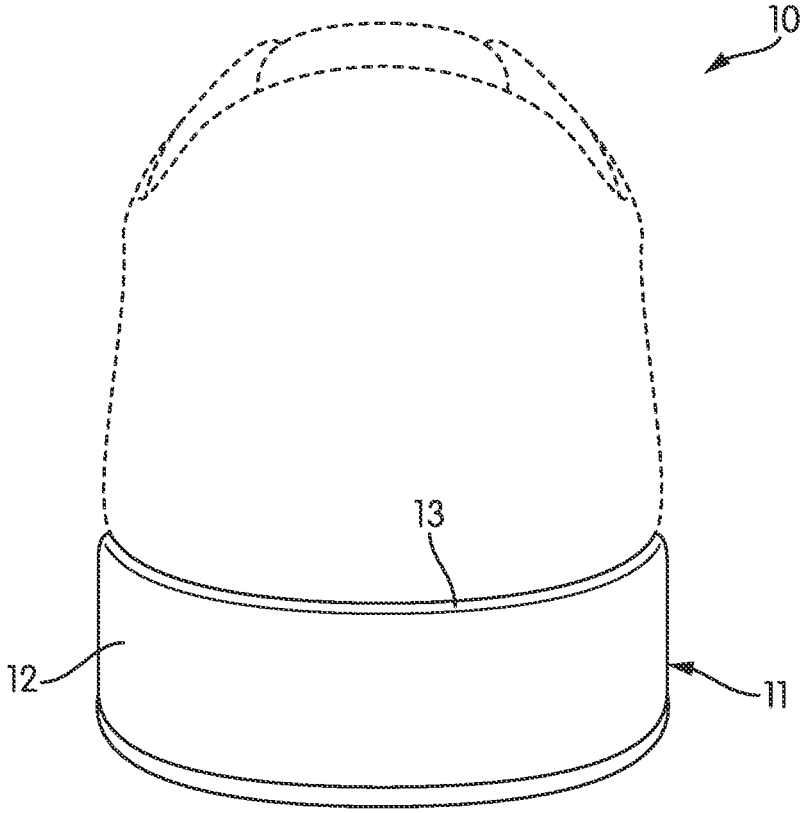
FIG. 1C is a rear view of the shoe of FIG. 1A.

FIG. 1A is a lateral front perspective view of a shoe 10 according to some embodiments. FIG. 1B is a medial front perspective view of shoe 10. FIG. 1C is a rear view of shoe 10. Shoe 10 is a left shoe and is part of a pair of shoes. For convenience, the right shoe of the pair is not shown in the drawings. However, in at least some embodiments, the right shoe of the pair is a mirror image of left shoe 10. This need not be the case, however. Shoe 10 and its associated right shoe are intended for wear by a golfer, but can also be worn in non-golf settings. Other embodiments can include footwear for use in other athletic and non-athletic activities.

Shoe 10 includes a sole structure 11. Sole structure 11 includes a sidewall 12 that wraps around the entire perimeter of shoe 10. As explained in more detail below, an interior portion of sole structure 11 below a top edge 13 of sidewall 12 forms a platform to support a foot of a shoe 10 wearer. That platform, together with regions of sidewall 12 below top edge 13, are bonded to an upper 14. Additional features of sole structure 11 are described below in connection with subsequent drawing figures, such description merely providing examples of features according to certain embodiments.

Shoes having sole structures according to various embodiments can include various types of uppers. The details of such uppers are not pertinent to understanding sole structures disclosed herein. Accordingly, upper 14 is shown generically in FIGS. 1A through 1C using a broken line. Upper 14 may include laces or other means for securing upper 14 (and thus, shoe 10) to a wearer's foot. In some embodiments, and although it is not visible in FIGS. 1A through 1C, shoe 10 further includes a removable interior midsole structure formed from a foam material. Additional aspects of that removable midsole are described below.

The locations of certain regions in sole structure 11, and in sole structures according to other embodiments, may be described using references to human foot anatomy. Specifically, various regions of a described sole structure may be identified using foot bones of a person wearing a shoe that includes the described sole structure. Identifications in this manner assume that the shoe is properly sized for the wearing foot.

When referring to a region or component of a sole structure, a "forefoot" region will generally lie under or near the metatarsal and phalangeal bones of a shoe wearer's foot and may extend beyond the wearer's toes to the front most portion of the shoe. A forefoot region may extend beyond the medial or lateral peripheral edge of the wearer's foot. A "midfoot" region will generally lie under or near the cuboid, navicular, medial cuneiform, intermediate cuneiform and lateral cuneiform bones of the wearer's foot. A midfoot region may also extend beyond the medial or lateral peripheral edge of the wearer's foot. A "hindfoot" or heel region of a sole structure extends from the midfoot region and under/near the wearer calcaneus (heel bone), may extend to the rearmost portion of the shoe, and may also extend beyond the medial or lateral peripheral edge of the wearer's foot. One or more of the above-described regions may overlap, and description of a component by reference to a particular anatomical region does not require that the component cover that entire anatomical region.

Figure 2A:
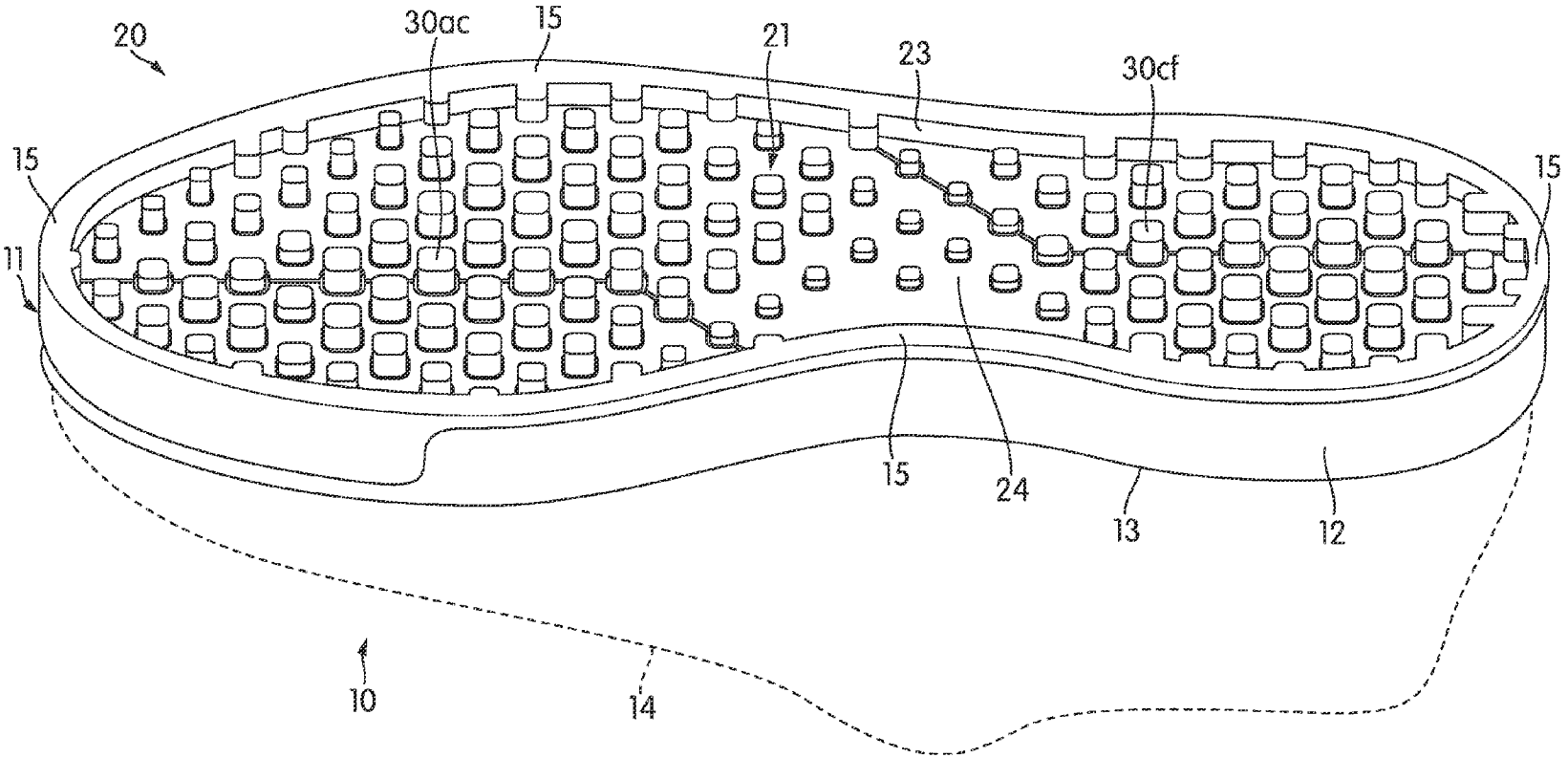
FIG. 2A is a medial bottom perspective view of the shoe of FIG. 1A.
Figure 2B:
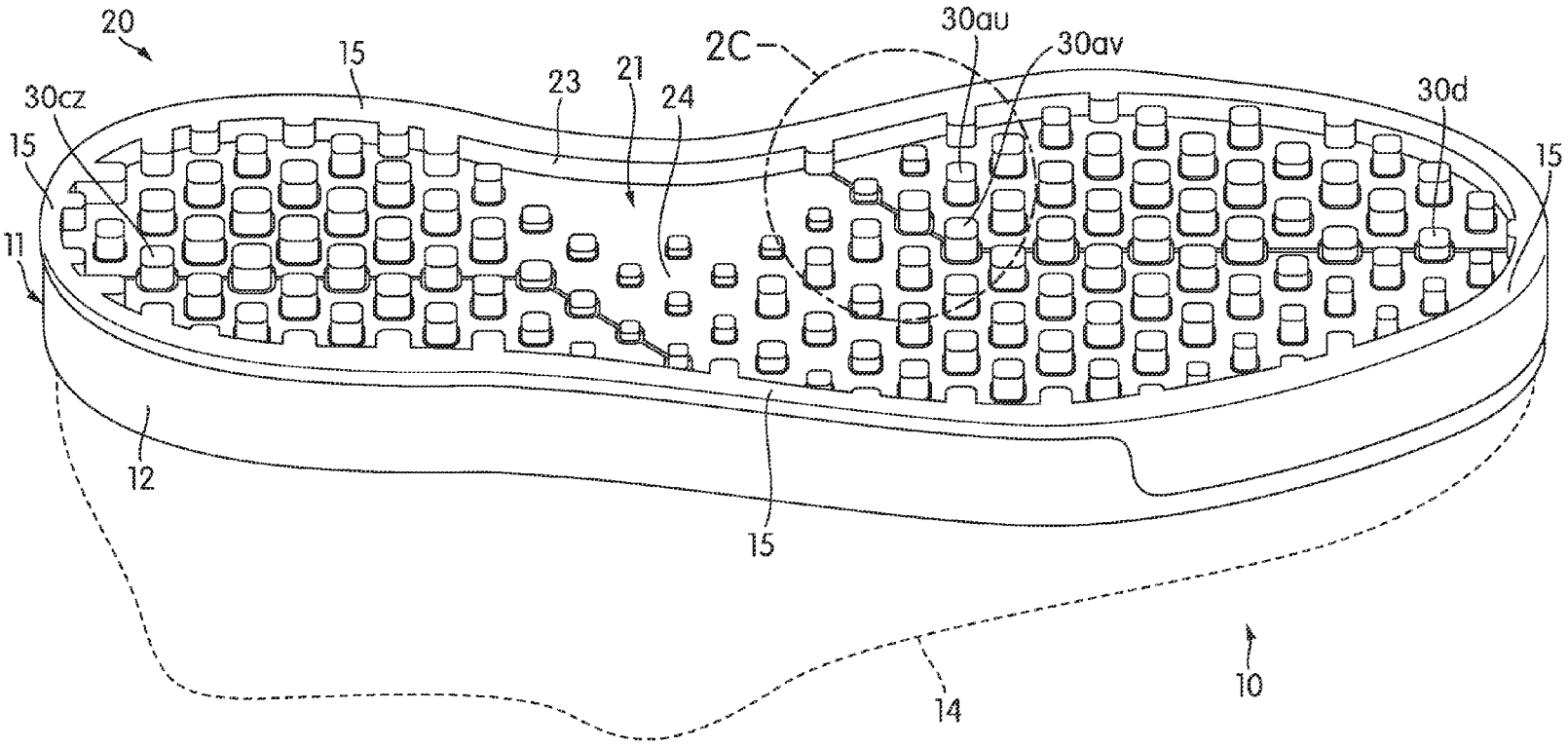
FIG. 2B is a lateral bottom perspective view of the shoe of FIG. 1A.

FIG. 2A is a medial bottom perspective view of shoe 10. FIG. 2B is a lateral bottom perspective view shoe 10. Sidewall 12 includes a bottom edge 15. Although sidewall bottom edge 15 appears at the top of the drawings in FIGS. 2A and 2B, edge 15 is nonetheless named based on its location when shoe 10 is upright and at rest (e.g., as shown in FIGS. 1A-1C). This component naming convention will be applied throughout the remainder of the description. Unless the context clearly indicates otherwise, bottom surfaces of other elements will refer to surfaces that may contact the ground when shoe 10 is in use and/or that may be the lowest portion of an element when shoe 10 is upright and unloaded.

For convenience, an outsole region 20 of sole structure 11 can be defined as including edge 15 and exposed regions of sole structure 11 inside of the perimeter of edge 15. Various portions of outsole region 20 contact the ground when a wearer of shoe 10 stands, walks, swings a golf club, or otherwise performs an activity.

Sole structure 11 further includes a flexible web 21 that forms a substantial portion of outsole region 20. Web 21 is integrally joined to sidewall 12 around the entire inside perimeter of sidewall 12. As seen in FIGS. 2A and 2B, web 21 meets sidewall 12 and forms a ridge 23 that extends below an exposed bottom side 24 of web 21. In other words, ridge 23 is the portion of sidewall 12 below bottom side 24 of web 21.

Figure 2C:
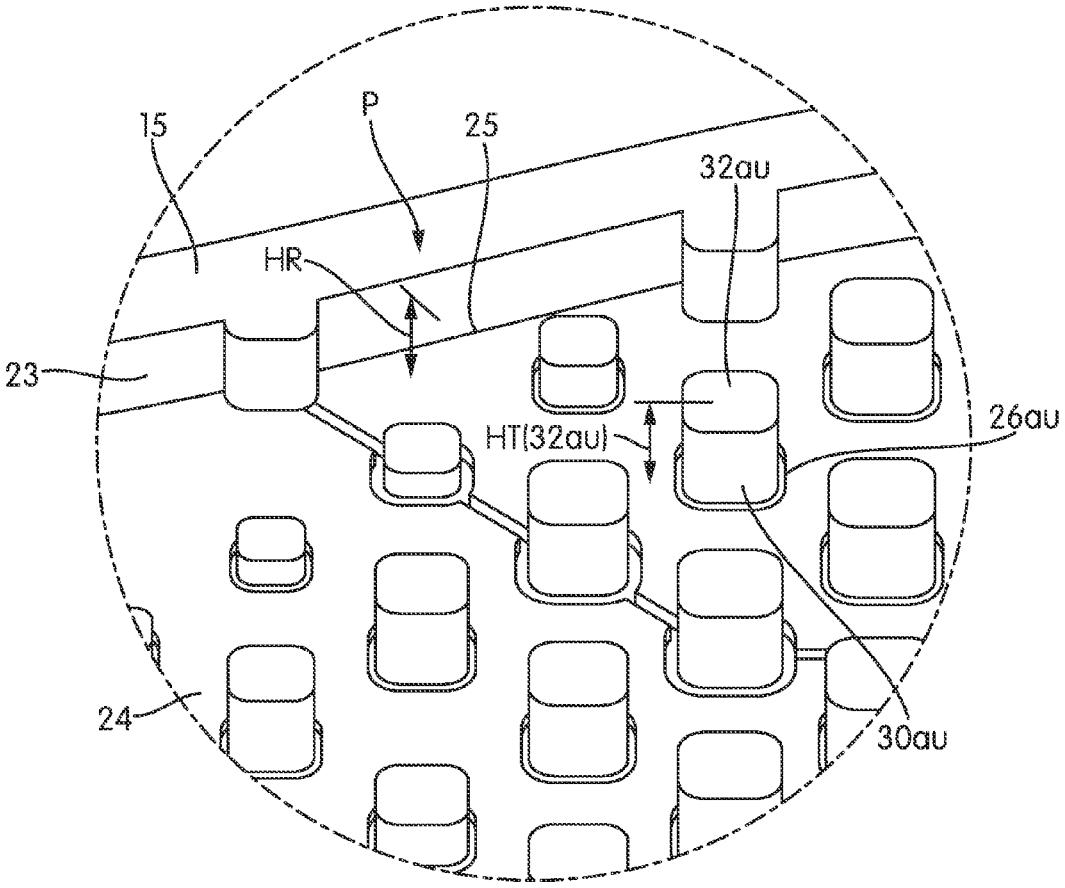
FIG. 2C is a partial enlarged view taken from the location indicated in FIG. 2B.

FIG. 2C is a partial enlarged view taken from the location indicated in FIG. 2B. The intersection of web 21 bottom side 24 with side wall 12 forms a base 25 of ridge 23. A height HR can be defined as a distance between base 25 and sidewall bottom edge 15 at a particular perimeter location (e.g., location P shown in FIG. 2C). In some embodiments, HR may not be constant over all of sole structure 11. Stated differently, a height HR1 at a first location P1 on sole structure 11 may be different from a height HR2 at a second location P2.

Sole structure 11 also includes multiple traction elements 30 located in outsole region 20. For simplicity, traction elements of sole structure 11 will be generically identified by reference character 30. Specific traction elements of sole structure 11 will be identified by reference character 30 with an appended suffix (e.g., traction element 30*a*). Each traction element is integrally attached to web 21 and extends downward from bottom side 24 of web 21. As explained in more detail below, a base groove 26 is formed around each traction element 30 in a portion of bottom surface 24 that surrounds that traction element 30.

In the embodiment of shoe 10, traction elements 30 are simple "lug" traction elements. Traction elements 30 are approximately square in cross-section, but have differing cross-sectional sizes and differing heights relative to surface 24. In some embodiments, and so as maintain flexibility of web 21, no traction element has a width dimension in any direction greater than approximately 10 millimeters. In other embodiments, this maximum width dimension could be smaller (e.g., approximately 8 millimeters or smaller).

Referring to FIG. 2C, traction element 30*au* has a bottom surface 32*au*. For simplicity and to avoid confusion of the drawings with excess detail, bottom surface 32*au* and bottom surfaces of other traction elements 30 are shown as flat. In some embodiments, however, traction element bottom surfaces may be non-flat. For example, in some embodiments each traction element bottom surface has a slight pyramid with a flattened apex, and with a rounded nub extending from the flattened apex. Each traction element 30 also has a height HT that can be defined as a distance from the adjacent bottom side 24 surface to the bottom most portion of the fraction element bottom surface. In determining HT, depth of the base groove 26 (e.g., depth of base groove 26*au* in this instance) can be ignored. In the case of traction element 30*au*, the height HT(30*au*) is the distance between bottom side 24 and the bottom most portion of bottom surface 32*au*.

In at least some embodiments, bottom surfaces of the traction elements do not extend significantly beyond a hypothetical surface defined by sidewall bottom edge 15 when shoe 10 is in an unloaded condition. Specifically, the lowest (i.e., bottom-most) points at each perimeter location of bottom edge 15 could be identified. Those points would then define a hypothetical surface. When shoe 10 is not loaded, no significant portion of a traction element 30 would pass through that hypothetical surface. In this context, "no significant portion" means no more than a few percent of the volume of the traction element. In some embodiments, no portion of a traction element would pass through that hypothetical surface.

The relationship between ridge and traction element height can be defined in other ways. For example, each of the traction elements 30 in a group of traction elements could have a height HT that is substantially the same as or less than the height HR of ridge 23 at a location that is closest to that traction element. As one illustration thereof, the height HT(30*au*) of traction element 30*au* is substantially the same or less than the height HR of ridge 23 at a location along ridge 23, which location is not specifically marked in FIG. 2C, that is closest to traction element 30*au*.

Figure 3A:
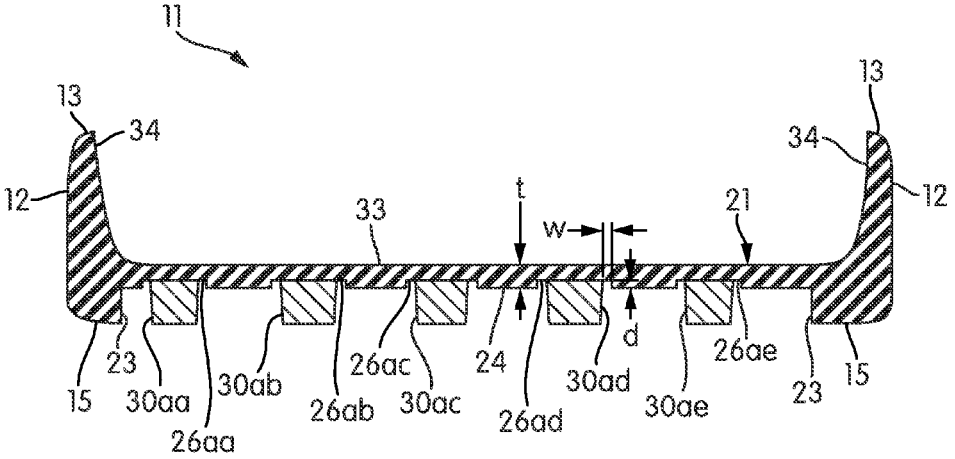
FIGS. 3A and 3B are enlarged, partially schematic, area cross-sectional views taken from the location indicated in FIG. 4.
Figure 4:
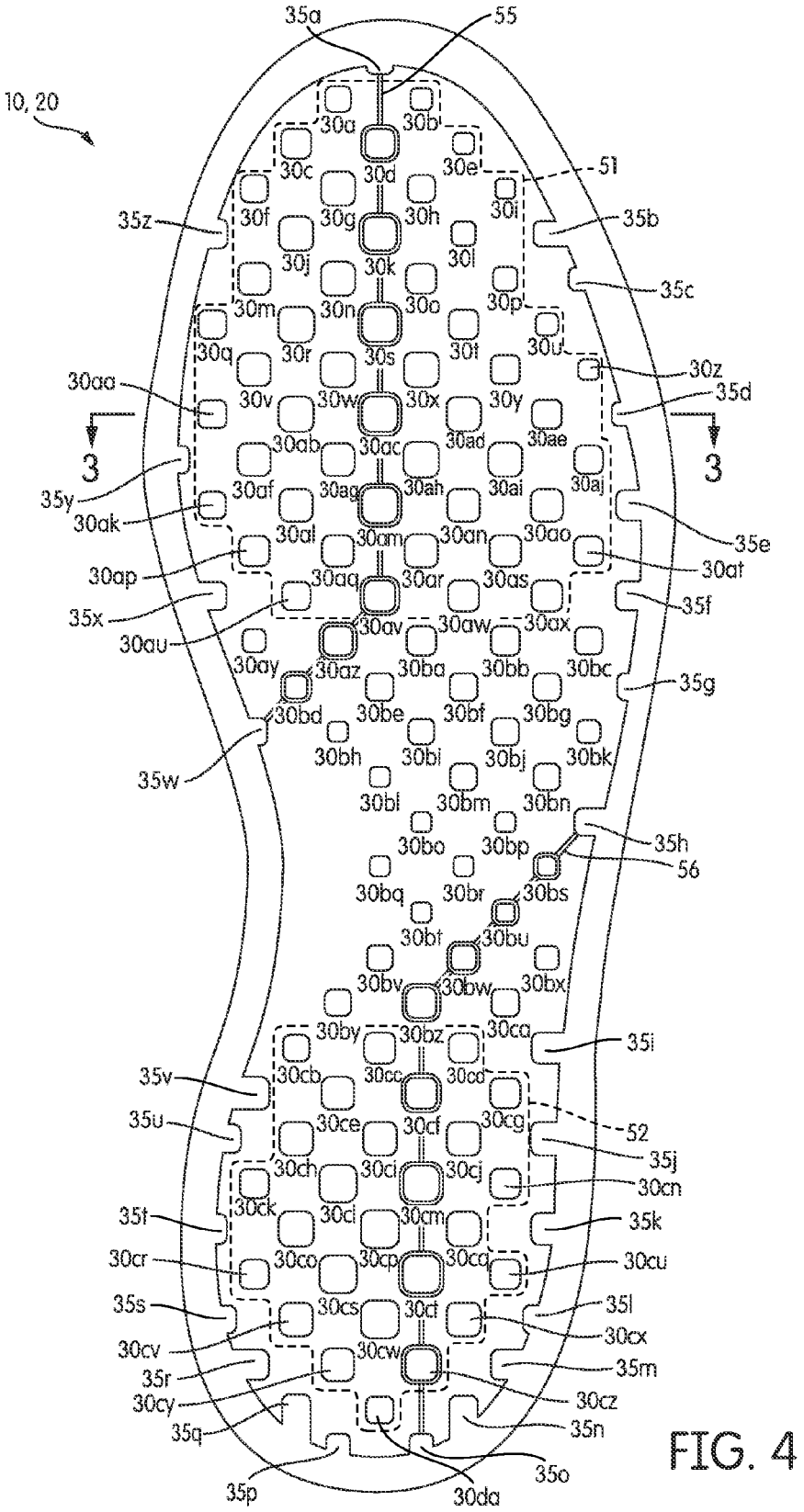
FIG. 4 is a bottom plan view of the shoe of FIG. 1A.

FIG. 3A is an enlarged, partially schematic, area cross-sectional view of sole structure 11 taken from the location indicated in FIG. 4. FIG. 4, a bottom plan view of shoe 10, is discussed in detail below. In FIG. 3A, all elements of shoe 10 other than sole structure 11 have been omitted. A top side 33 of flexible web 21 forms a platform to support the foot of a shoe 10 wearer. An upper part of an interior perimeter of sidewall 12 acts as a support wall 34 to resist medial, lateral, forward and rearward movement of the wearer foot across that platform. FIG. 3A only shows a medial and a lateral portion of support wall 34 extending above web 21. However, and as can be appreciated from FIGS. 1A-1C, sidewall 12 wraps around the entire perimeter of sole structure 11. Because web 21 is joined to sidewall 12 at approximately the same level over the entire area of sole structure 11, the intersection of web 21 and sidewall 12 forms support wall 34 around the entire upper perimeter sole structure 11 in a manner similar to that in which ridge 23 is formed around the entire lower perimeter of sole structure 11.

Sidewall 12 is relatively thick, at least in the lower portions below web 21. This thickness allows ridge 23 to provide significant support for the weight of a shoe 10 wearer, particularly when the wearer is standing or walking casually on a firm surface. Example thickness of ridge 23, not including tabs 35 (discussed below), is approximately 6-7 millimeters for a men's size 10 shoe. Web 21 is relatively thin, however. As discussed in more detail below, this allows increased flexibility of web 21 in response to forces resulting from wearer activity. Although FIG. 3A only shows the thickness of web 21 in the location indicated in FIG. 4, web 21 is of relatively thin thickness throughout the entire length and width of sole structure 11. In some embodiments, web 21 has a thickness t of between 1.5 millimeters (mm) and 2.5 mm for a men's size 10 shoe.

As also seen in FIG. 3A, traction elements 30 are integrally formed with web 21. In some embodiments, sole structure 11, which includes sidewall 12, web 21 and traction elements 30, is molded as a single unit. Sole structure 11 can be molded from one or more elastomeric materials. Examples of elastomeric materials that can be used include, without limitation, synthetic rubber. In some embodiments, sole structure 11 is molded in a single-shot molding process wherein a single material is used. In alternate embodiments, a multiple shot molding process and multiple materials could be used. For example, a first step could mold the bottom portions of the traction elements and of the sidewall from a first type of synthetic rubber, and a second step could then mold the remainder of the sole structure (e.g., the remainder of the traction elements, the web, the remainder of the sidewall) around the bottoms of the traction elements and sidewall from a second type of synthetic rubber. The first type of synthetic rubber could be harder and more durable, but the second type might be softer and more flexible. Additional variations on a molding process could be employed so as to also obtain a sole structure in which the sidewall, web and traction elements are an integral unit.

As previously indicated, a base groove 26 is formed around each traction element 30 in a portion of the bottom side 24 surface that surrounds that traction element 30. Additional details of these base grooves can be seen with regard to five traction elements in FIG. 3A. Specifically, a base groove 26*aa* surrounds traction element 30*aa* in the portion of bottom side 24 immediately adjacent to the base of traction element 30*aa*. Grooves 26*ab*, 26*ac*, 26*ad* and 26*ae* similarly surround traction elements 30*ab*, 30*ac*, 30*ad* and 30*ae*, respectively. Each of the other traction elements 30 of sole structure 11 similarly has a corresponding surrounding groove. These grooves allow increased flexibility of web 21. Example dimensions for grooves 26 are a groove width w of 1 mm to 1.5 mm and a groove depth d of 0.75 mm to 1.5 mm.

Figure 3B:
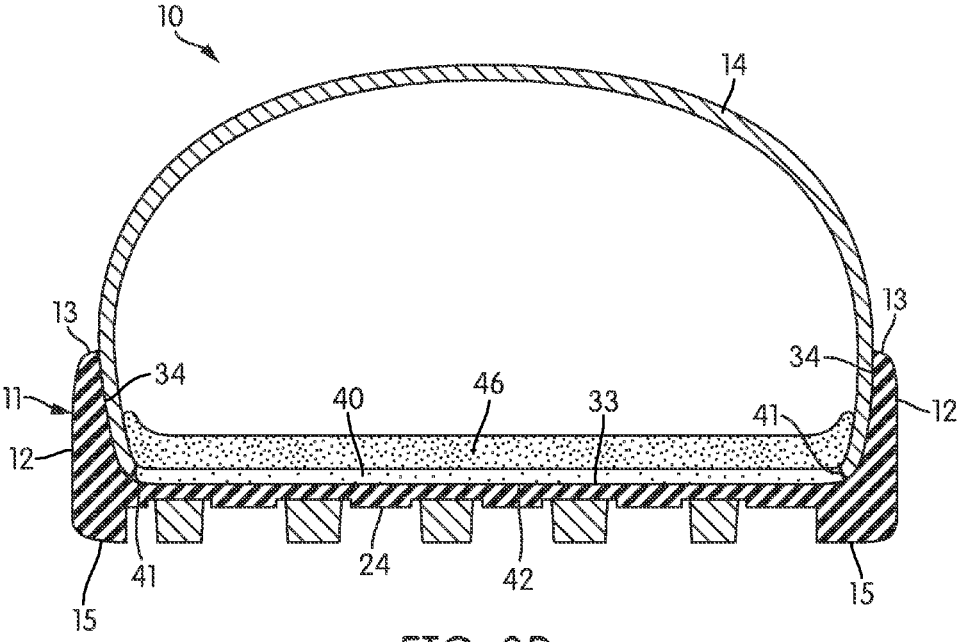

FIG. 3B is an enlarged, partially schematic, area cross-sectional view of shoe 10 taken from the location indicated in FIG. 4. FIG. 3B is similar to FIG. 3A, but includes other elements of shoe 10 in addition to sole structure 11. Upper 14 of shoe 10 includes a lasting element 40 (e.g., a Strobel) that can be stitched or otherwise attached to the top elements of upper 14 around a footbed perimeter 41. While upper 14 with attached lasting element 40 is on a last, upper 14 is bonded directly onto sole structure 11. In particular, the bottom surface 42 of lasting element 40 is bonded to top side 33 of web 21. Interior faces of support wall 34 are then bonded to corresponding faces of upper 14 around the entire perimeter of shoe 10.

Also visible in FIG. 3B is a portion of a removable interior midsole structure 46. Removable midsole 46 is formed from a foam material. Examples of foam materials that can be used for midsole 46 include foam materials used in the LUNAR family of footwear products available from NIKE, Inc. of Beaverton, Oreg. Additional examples of foam materials that can be used for midsole 46 include materials described in U.S. Pat. No. 7,941,938, which patent is hereby incorporated by reference herein. In some embodiments, midsole 46 is relatively flat in the forefoot and heel regions, with the heel region being raised relative to the forefoot.

FIG. 4 is a bottom plan view of shoe 10 showing outsole region 20 of sole structure 11. To avoid confusing FIG. 4 with unnecessary detail, a portion of base grooves 26 have been omitted. In FIG. 4, each of traction elements 30 has been individually numbered 30*a* through 30*da* for purposes of further discussion. Sole structure 11 includes two main clusters of lugs. A first cluster 51 is located in the forefoot region and is slightly weighted toward the medial side. In particular, a more of the larger lugs in cluster 51 are located on the medial side. For example, lugs 30*h*, 30*l*, 30*p*, 30*u* and 30*z* at the far lateral side are substantially smaller than other lugs in cluster 51. Lugs 30*o*, 30*t*, 30*y*, 30*ae* and 30*aj* are also significantly smaller than other lugs within cluster 51. Conversely, lugs 30*g*, 30*j*, 30*k*, 30*m*, 30*n*, 30*r*, 30*s*, 30*v*-30*x*, 30*ab*-30*ad*, 30*af*-30*ai*, 30*al*-30*ao*, and 30*ap*-30*at* are larger.

A second cluster 52 of lugs 30 is located in the heel region. Most of the lugs in cluster 52 are also relatively large. Lugs 30*cl*, 30*cm*, 30*co*, 30*cp*, 30*cq*, 30*cs*, 30*ct* and 30*cw* are generally located under a wearer calcaneus and are the largest lugs in cluster 52. The remaining lugs in cluster 52 are slightly smaller and surround the lugs under the wearer calcaneus.

Lugs are absent from much of the midfoot region of outsole region 20. Where lugs are included in the midfoot region, many are of relatively small cross-sectional area and/or have a reduced height. For example, lugs 30*bd*, 30*bh*, 30*bl*, 30*bo*, 30*bq*, 30*br*, 30*bs*, 30*bt*, 30*bu*, 30*bv*, 30*bw*, 30*by* and 30*bz* and 30*ca* have minimal height relative to other lugs of sole structure 20.

As also seen in FIG. 4, as well as in FIGS. 2A-2C, sole structure 11 further includes multiple tabs 35. Tabs 35, individual ones of which are also identified in FIG. 4 by appended suffixes (i.e., as tabs 35*a*-35*z*), extend inward from ridge 23. Each tab 35 is integrally joined to ridge 23 and to web 21. Each of tabs 35 is relatively narrow, and does not extend significantly toward the interior of outsole region 20. In particular, none of tabs 35 is wider than any of traction elements 30. No tab 35 has a height that extends beyond the height of ridge 23 at the perimeter location where that tab 35 joins ridge 23. In the embodiment of shoe 10, the height of each tab 35 is the same as the height of ridge 23 at the location where that tab 35 is joined to ridge 23.

Two flex grooves are also formed in bottom side 24 of web 21. A forefoot flex groove 55 extends rearward along a longitudinal line approximately located under the second phalanges and second metatarsal. Groove 55 then rearwardly angles outward to the medial side in the midfoot region. Groove 56 extends forward along a longitudinal line approximately located under the lateral side of the center of the calcaneus. Groove 56 then forwardly angles outward to the lateral side in the midfoot region. Grooves 55 and 56 also increase flexibility of web 21.

A shoe with a sole structure configuration such as that of shoe 10 offers various advantages. When walking on the golf course, traction elements 30 and tabs 35 assist the wearer of shoe 10 by providing traction in sand, grass, wet ground, uneven terrain, etc. When traversing these and other types of surfaces, the wearer's foot will typically depress the surface somewhat, thereby pushing the fraction elements into the ground surface.

When a wearer of shoe 10 swings a golf club, the shifting weight of the wearer over the course of the swing results in an increase in the downward force applied to certain areas of web 21. In other words, as a wearer swings a golf club, the wearer shifts more of his or her weight to a particular foot and to particular parts of that foot. Those foot parts push down on the regions of web 21 with increased force during the swing and cause those regions of web 21 to protrude downward. Traction elements located on those downwardly protruding portions of the web can then engage the ground. By engaging the ground at zones of localized foot pressure, shoe 10 can increase golfer stability during the swing.

The sizes, heights and/or placements of these differently-configured tractions elements are, in at least some embodiments, chosen based on pressure mapping of forces applied by a golfer's foot during a golf swing. As indicated above, first cluster 51 is located in the forefoot region and is slightly weighted toward the medial side. During the downswing phase of a golf swing, a golfer typically pushes off on the medial toe side of his or her back foot. Accordingly, traction elements within cluster 51, especially fraction elements in the medial side of cluster 51, would be pushed downward and provide ground engagement for the golfer during the downswing.

The preceding example assumes that shoe 10, a left shoe, is worn by a right handed golfer. However, a similar result would occur if a right shoe counterpart of shoe 10 were worn by a left handed golfer during that left handed golfer's downswing.

When a wearer of shoe 10 is not on the golf course, shoe 10 does not interfere with other activities. For example, when the wearer is standing on a hard surface, web 21 will be minimally deformed, and much of the wearer weight will be transferred to the ground by ridge 23 and tabs 35. This allows the wearer to comfortably stand on that hard surface. When the wearer of shoe 10 walks on that hard surface, web 21 will be slightly more deformed, and more of the weight of the wearer will be supported by traction elements that contact the ground as the wearer walks. However, that deformation will be more evenly distributed across web 21 than would be the case during a golf swing, and a large portion of the wearer weight will still be transferred to the ground through ridge 23 and tabs 35. As a result, structures on shoe 10 that provide stability and traction on the golf course do not cause discomfort or inconvenience when in an off-course setting.

The foregoing merely describes certain embodiments. Additional embodiments include numerous variations. Numerous materials other than those identified above could be used. The specific traction element shapes described above, as well as the pattern and arrangement of traction elements described herein, merely represent one embodiment. Other embodiments include sole structures in which the traction elements have different shapes, as well as embodiments in which the fraction elements may be arranged in other patterns. In some embodiments, a left shoe and a right shoe of a pair may not have the same pattern of traction elements. In some embodiments, one or more features described above may not be present. As but one example thereof, a sidewall, a ridge or other sole structure element may only substantially surround a sole structure. In some such embodiments, there may be one or more gaps in a ridge and/or sidewall. Similarly, a flexible web may be attached substantially all around the perimeter of a shoe to a ridge, sidewall, and/or other support structure, but there may be one or more gaps where the web is not attached.

The foregoing description of embodiments has been presented for purposes of illustration and description. The foregoing description is not intended to be exhaustive or to limit embodiments to the precise form explicitly described or mentioned herein. Modifications and variations are possible in light of the above teachings or may be acquired from practice of various embodiments. The embodiments discussed herein were chosen and described in order to explain the principles and the nature of various embodiments and their practical application to enable one skilled in the art to make and use these and other embodiments with various modifications as are suited to the particular use contemplated. Any and all permutations of features from above-described embodiments are the within the scope of the invention. References in the claims to characteristics of a physical element relative to a wearer of claimed article, or relative to an activity performable while the claimed article is worn, do not require actual wearing of the article or performance of the referenced activity in order to satisfy the claim.

The invention claimed is:

1. An article of footwear, comprising:

an upper; and a sole structure secured to the upper, the sole structure comprising a flexible web extending substantially an entire length and width of the sole structure and having an exposed bottom side configured to face a ground surface when the article is in use, a sidewall extending upwardly from and about an entire perimeter of the flexible web, a ridge integral to and extending downward from the sidewall and extending along an entire length of the sidewall, a plurality of traction elements integral to and extending downward from the bottom side of the flexible web, the plurality including a first cluster of traction elements located in a forefoot region of the sole structure and being at least slightly weighted toward a medial side, wherein a lateral side and a medial side of the first cluster include larger and smaller traction elements and the medial side includes more larger elements than the lateral side, each of the traction elements is completely surrounded by a corresponding traction element base groove formed in a portion of the web on the bottom side adjacent to a base of the traction element, each base groove formed of a base wall extending away from a bottom of a corresponding traction element and a side wall extending from the base wall to an exterior surface of the flexible web, and the sole structure further includes multiple tabs extending inward from the ridge, wherein each of the tabs is integral to the ridge and to the web, and wherein each of the tabs has a height that is the same as a height of the ridge at a location where the tab is joined to the ridge.

2. The article of footwear of claim 1, wherein the plurality of traction elements comprises a second cluster of traction elements located in a heel region of the sole structure, and wherein arch and midfoot regions of the bottom side contain traction elements that are substantially smaller than traction elements contained in the first and second clusters.

3. The article of footwear of claim 2, wherein the each of the traction elements has a height relative to the bottom side that is substantially the same as a height of a portion of the ridge at a location that is closest to that traction element.

4. The article of footwear of claim 1, wherein the traction elements are generally square in cross section.

5. The article of footwear of claim 1, wherein the traction elements have widths no larger than 10 millimeters.

6. The article of footwear of claim 1, wherein the flexible web is formed from an elastomeric material and has a thickness of between 1.5 millimeters and 2.5 millimeters, and wherein each of the base grooves has a groove width between 1 millimeter and 1.5 millimeter and a groove depth, relative to surrounding portions of the bottom side, between 0.75 millimeter and 1.5 millimeter.

7. The article of footwear of claim 6, wherein the flexible web comprises a forefoot flex groove formed as a first series of groove segments in the bottom side, each of the groove segments of the first series being a depression in the flexible web relative to adjacent regions of the flexible web on the bottom side, the forefoot flex groove extending rearward along a longitudinal line approximately located under a region of the sole structure corresponding to a second phalanges and a second metatarsal and rearwardly angling toward a medial side in a midfoot region, each groove segment in a portion of the groove segments of the first series extending between two traction elements from a first subset of the traction elements in the first cluster and joining with base grooves surrounding those two traction elements.

8. The article of footwear of claim 7, wherein the flexible web comprises a heel flex groove formed as a second series of groove segments in the bottom side, each of the groove segments of the second series being a depression in the flexible web relative to adjacent regions of the flexible web on the bottom side, the heel flex groove extending forward along a longitudinal line and forwardly angling toward the lateral side in the midfoot region, each groove segment in a portion of the groove segments of the second series extending between two traction elements from a second subset of the traction elements in the second cluster and joining with base grooves surrounding those two traction elements.

9. The article of footwear of claim 8, wherein the flexible web comprises a top side opposite the bottom side, and a bottom surface of a lasting element of the upper is bonded directly to the top side.

10. The article of footwear of claim 9, wherein the sole structure is molded as a single unit from synthetic rubber, the flexible web is joined and integral to an interior perimeter of the sidewall, portions of the sidewall above the top side form a support wall around the entire outer perimeter, and the upper is bonded directly to inner surfaces of the support wall.

11. An article of footwear, comprising:

a sole structure molded as a single unit from one or more elastomeric materials, the sole structure comprising a flexible web formed from a single one of the one or more elastomeric materials and extending substantially an entire length and width of the sole structure and having an exposed bottom side configured to face a ground surface when the article is in use, and a top side opposite the bottom side, a sidewall extending upwardly from and about an entire outer perimeter of the flexible web, a ridge integral to and extending downward from the sidewall and extending along an entire length of the sidewall, a plurality of traction elements integral to and extending downward from the bottom side of the flexible web, wherein each of the traction elements is surrounded by a corresponding traction element base groove formed in a portion of the web on the bottom side adjacent to a base of the traction element, each base groove formed of a base wall extending away from a bottom of a corresponding traction element and a side wall extending from the base wall to an exterior surface of the flexible web, and the sole structure further includes multiple tabs extending inward from the ridge, wherein each of the tabs is integral to the ridge and to the web, and wherein each of the tabs has a height that is the same as a height of the ridge at a location where the tab is joined to the ridge; and an upper, wherein a bottom surface of a lasting element of the upper is bonded directly to the top side.

12. The article of footwear of claim 11, wherein each of the traction elements has a height relative to the bottom side that is substantially the same as a height of a portion of the ridge at a location that is closest to that traction element.

13. The article of footwear of claim 11, wherein the traction elements have widths no larger than 10 millimeters.

14. The article of footwear of claim 11, wherein the flexible web has a thickness of between 1.5 millimeters and 2.5 millimeters.

15. The article of footwear of claim 11, wherein the flexible web comprises a forefoot flex groove formed as a first series of groove segments in the bottom side, each of the groove segments of the first series being a depression in the flexible web relative to adjacent regions of the flexible web on the bottom side, the forefoot flex groove extending rearward along a longitudinal line approximately located under a region of the sole structure corresponding to a second phalanges and a second metatarsal and rearwardly angling toward a medial side in a midfoot region, each groove segment in a portion of the groove segments of the first series extending between two traction elements from a first subset of the traction elements in a forefoot region and joining with base grooves surrounding those two traction elements.

16. The article of footwear of claim 15, wherein the flexible web comprises a heel flex groove formed as a second series of groove segments in the bottom side, each of the groove segments of the second series being a depression in the flexible web relative to adjacent regions of the flexible web on the bottom side, the heel flex groove extending forward along a longitudinal line and forwardly angling toward a lateral side in the midfoot region, each groove segment in a portion of the groove segments of the second series extending between two traction elements from a second subset of the traction elements in a heel region and joining with base grooves surrounding those two traction elements.

17. The article of footwear of claim 11, wherein the sole structure is molded from synthetic rubber, the flexible web is joined and integral to an interior perimeter of the sidewall, portions of the sidewall above the top side form a support wall around the entire outer perimeter, and the upper is bonded directly to inner surfaces of the support wall.

18. An article of footwear, comprising:

an upper; and a sole structure molded as a single unit from synthetic rubber and secured to the upper, the sole structure comprising a flexible web extending substantially an entire length and width of the sole structure and having an exposed bottom side configured to face a ground surface when the article is in use, a ridge substantially surrounding an entire outer perimeter of the sole structure, the ridge joined to and extending downward from the bottom side of the flexible web, a plurality of traction elements integral to and extending downward from the bottom side of the flexible web, wherein each of the traction elements is surrounded by a corresponding traction element base groove formed in a portion of the web on the bottom side adjacent to a base of the traction element, each base groove formed of a base wall extending away from a bottom of a corresponding traction element and a sidewall extending from the base wall to an exterior surface of the flexible web, and the sole structure further includes multiple tabs extending inward from the ridge, wherein each of the tabs is integral to the ridge and to the web, and wherein each of the tabs has a height that is the same as a height of the ridge at a location where the tab is joined to the ridge.

19. The article of footwear of claim 18, wherein each of the traction elements has a height relative to the bottom side that is substantially the same as a height of a portion of the ridge at a location that is closest to that traction element.

20. The article of footwear of claim 18, wherein the traction elements have widths no larger than 10 millimeters.

21. The article of footwear of claim 18, wherein the flexible web has a thickness of between 1.5 millimeters and 2.5 millimeters.

22. The article of footwear of claim 18, wherein the flexible web comprises a forefoot flex groove formed as a first series of groove segments in the bottom side, each of the groove segments of the first series being a depression in the flexible web relative to adjacent regions of the flexible web on the bottom side, the forefoot flex groove extending rearward along a longitudinal line approximately located under a region of the sole structure corresponding to a second phalanges and a second metatarsal and rearwardly angling toward a medial side in a midfoot region, each groove segment in a portion of the groove segments of the first series extending between two traction elements from a first subset of the traction elements in a forefoot region and joining with base grooves surrounding those two traction elements.

23. The article of footwear of claim 22, wherein the flexible web comprises a heel flex groove formed as a second series of groove segments in the bottom side, each of the groove segments of the second series being a depression in the flexible web relative to adjacent regions of the flexible web on the bottom side, the heel flex groove extending forward along a longitudinal line and forwardly angling toward a lateral side in the midfoot region, each groove segment in a portion of the groove segments of the second series extending between two traction elements from a second subset of the traction elements in a heel region and joining with base grooves surrounding those two traction elements.

24. The article of footwear of claim 18, wherein the flexible web comprises a top side opposite the bottom side, and a bottom surface of a lasting element of the upper is bonded directly to the top side.

25. The article of footwear of claim 18, wherein the sole structure comprises a sidewall surrounding the entire outer perimeter of the sole structure, the flexible web is joined and integral to an interior perimeter of the sidewall, the flexible web comprises a top side opposite the bottom side, portions of the sidewall below the bottom side form the ridge, portions of the sidewall above the top side form a support wall around the entire outer perimeter, and a bottom surface of a lasting element of the upper is bonded directly to the top side and a portion of the upper is bonded to inner surfaces of the support walls.

* * * * *